United States Patent [19]

Stadele et al.

[11] Patent Number: 4,862,686

[45] Date of Patent: Sep. 5, 1989

[54] SUPPORT STAND FOR A TEXTILE MACHINE

[75] Inventors: Norbert Stadele, Goppingen; Thomas Grollmann, Albershausen; Friedrich Dinkelmann, Rechberghausen, all of Fed. Rep. of Germany

[73] Assignee: Zinser Textilmaschinen GmbH, Fed. Rep. of Germany

[21] Appl. No.: 209,710

[22] Filed: Jun. 22, 1988

[30] Foreign Application Priority Data

Jun. 23, 1987 [DE] Fed. Rep. of Germany ..... 3720631

[51] Int. Cl.[4] ..... D01H 1/16

[52] U.S. Cl. ..... 57/1 R

[58] Field of Search ..... 57/1 R

[56] References Cited

U.S. PATENT DOCUMENTS

| | | | |
|---|---|---|---|
| 2,923,119 | 2/1960 | Nifenecker | 57/1 R |
| 3,075,341 | 1/1963 | Latus | 54/1 R |
| 3,103,095 | 9/1963 | Keyser | 57/1 R |
| 3,381,458 | 5/1968 | Rajnoha et al. | 57/1 R |
| 3,936,995 | 2/1976 | Laflaquiere et al. | 57/1 R |
| 3,977,168 | 8/1976 | Schewe | 57/1 R |
| 3,990,219 | 11/1976 | Schewe | 57/1 R |
| 4,204,391 | 5/1980 | Clayton | 57/1 R |

FOREIGN PATENT DOCUMENTS

| | | |
|---|---|---|
| 97021 | 12/1983 | European Pat. Off. . |
| 2931190 | 2/1980 | Fed. Rep. of Germany . |
| 3344440 | 7/1984 | Fed. Rep. of Germany . |

*Primary Examiner*—Donald Watkins

*Attorney, Agent, or Firm*—Shefte, Pinckney & Sawyer

[57] ABSTRACT

A lightweight, rigidified support stand for textile spinning and like machines may be easily manufactured with close tolerances without resort to a casting process by welding together a profiled sheet metal base having a substantially flat main support surface provided with a plurality of receptacles for fastening of machines components and a sheet metal brace member of a U-shaped profile. The formation of the fastener receptacles in the base member enables the receptacles to be arranged in a single plane with close tolerances, while the brace member serves to rigidify the base member.

6 Claims, 2 Drawing Sheets

SUPPORT STAND FOR A TEXTILE MACHINE

BACKGROUND OF THE INVENTION

The present invention relates to a support stand for a textile machine, particularly textile spinning or twisting machines. More particularly, the present invention relates to such a stand of the type formed by profiled sheet metal components welded together to form a hollow stand body having receptacles for fastening and supporting components of the textile machine.

A support stand of the aforementioned type is disclosed in West German Offenlegungsschrift DE33 44 440 A as embodied in a loom frame wherein the side walls of the frame are formed by two carrier plates each formed with bent flanges and being welded together in adjacent parallel relationship, with openings being formed in the side walls to permit fastening or mounting of other functional components of the loom. Disadvantageously, close tolerances cannot easily be maintained through the process of bending and welding the carrier plates to one another so that it is necessary to form the aforesaid openings through the side walls after the welding process which considerably increases the expense of fabrication.

SUMMARY OF THE INVENTION

It is accordingly an object of the present invention to provide a support stand for a textile machine which can be manufactured in a simple manner while assuring close tolerances for receptacles for fastening machine components and the like.

In accordance with this object, the present invention provides a textile machine support stand which, briefly summarized, includes a profiled sheet metal base member and a profiled sheet metal brace member welded together forming a hollow body portion of the support stand, with the base member having a substantially flat main support surface provided with a plurality of receptacles for fastening of machine components while the brace member serves to rigidify the base member.

In this manner, the receptacles may be arranged in a single plane and may be preformed precisely with close tolerances in the base member in advance of final formation thereof into its profiled configuration and in advance of welding of the base and brace members together. For example, the receptacles may be formed as openings in the main support surface of the base member, which openings may be readily stamped with precision in a metal sheet from which the base member is to be fabricated and the metal sheet may then be bent or otherwise formed into a desired profile while maintaining the precise arrangement of the receptacle openings with respect to one another. In this manner, a textile machine support stand of considerable rigidity may be manufactured in a relatively simple manner, particularly without any necessary reworking following fabrication, and enables receptacles for fastening machine components to be precisely arranged at relatively close tolerances with respect to one another.

According to a feature of the present invention, the base member is formed from a planar metal sheet having a main body which forms the main support surface and having a plurality of flanges bent at approximately right angles with respect to the main support surface with adjacent edges of the flanges abutting and being welded to one another. In this manner, the main support surface may be readily and easily formed as substantially flat and planar with the receptacles being substantially coplanar with one another, while the formation and welding of the flanges to one another provides additional rigidity to the support stand. According to another feature of the present invention, the brace member is substantially U-shaped and is welded to the main support surface of the base member by the lateral leg portions of the brace member to provide rigidity to the support stand. Preferably, the main support surface of the base member is of a larger area than the U-shaped brace member with the brace member being welded in a substantially vertical disposition to the main support surface of the base member.

Preferably, a pair of foot portions are formed as a part of, or are attached to, the base member in laterally spaced relationship to enable the support stand to be conveniently supported on a floor surface. As desired, the foot portions may be provided with height-adjustable elements for ready adjustment of the support stand.

As necessary or desirable, the receptacles of the main support surface of the base member may be fitted with fasteners which themselves have respective receptacles disposed out of co-planar relation with the main support surface, enabling textile machine components which extend longitudinally therealong to be precisely fastened to the stand. Preferably, the fasteners are produced as cast components which further increases the preciseness of the mounting of machine components.

DESCRIPTION OF THE PREFERRED EMBODIMENT

Figure 1:
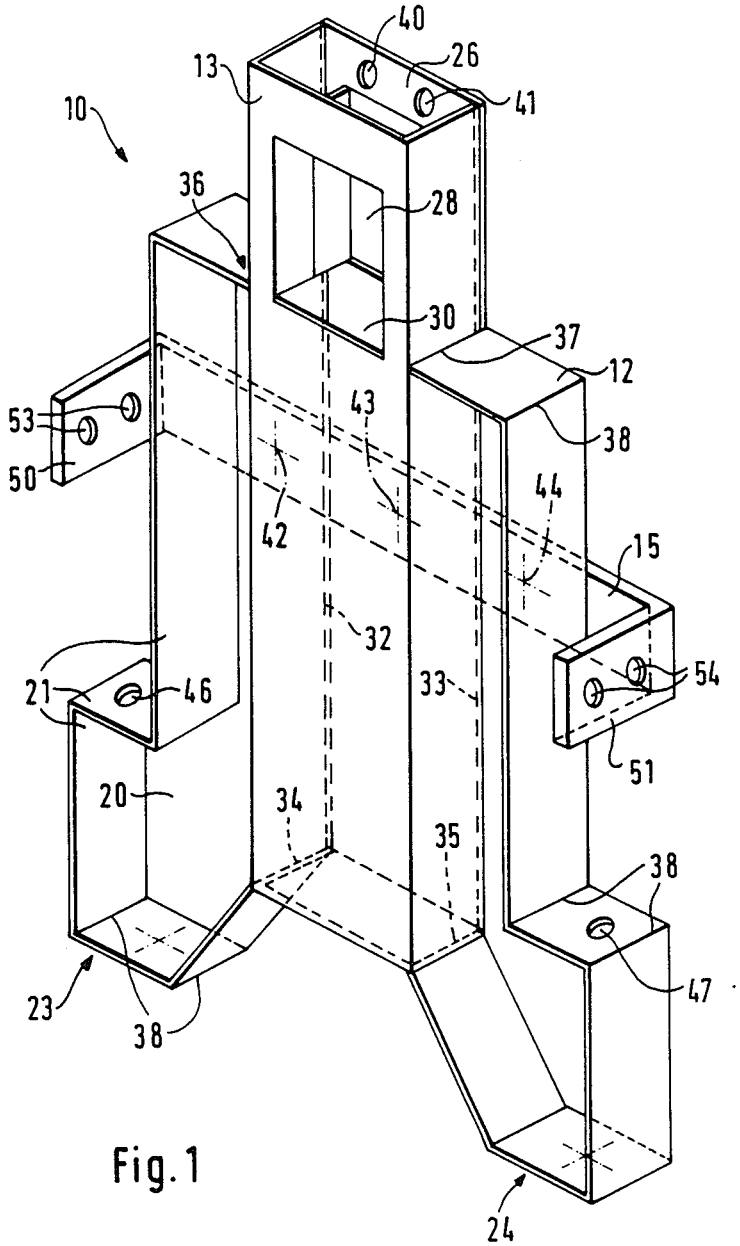
FIG. 1 is a perspective view of an intermediary support stand according to the present invention as preferably embodied for use as part of a carrier frame for a textile spinning machine, the stand including a cast fastener bridge.

Referring now to the accompanying drawings and initially to FIG. 1, an intermediary support stand is indicated broadly at 10 in a preferred embodiment according to the present invention for use in conjunction with other like stands for supporting components of a textile spinning, twisting or similar machine. The support stand 10 basically comprising a sheet metal shell 12 and a sheet metal face 13. The shell 12 is of the approximate shape of an inverted T having oppositely horizontally extending lower shanks forming spaced foot portions 23, 24 with a substantially vertically upstanding main body terminating at its upper end to form a head portion 26. The shell 12 has a substantially flat planar base surface 20 with integral side walls 21 bent at the outer peripheral edges of the base surface 20 at substantially right angles to the base surface 20 wherein the respective edges 38 of the side walls 21 abut adjacently with and are welded to one another.

As shown in FIG. 1, the shell 12 is thereby adapted to be supported by its foot portions 23, 24 in substantially upstanding disposition on a floor surface, such as in a textile spinning mill. As described, the lower side walls at the foot portion 23, 24 may have height-adjustable devices fastened thereto by which the sheet metal shell 12 stands on the floor surface and may be adjusted to a desired level disposition. In any event, the base surface 20 of the shell 12 is disposed generally vertically with the head portion 26 located generally centrally above the foot portions 23 ,24. The sheet metal face 13 is formed of a substantially U-shaped cross section with its shanks or lateral leg portions being of substantially the same height as the side walls 21 of the sheet metal shell 12, but the base surface 20 of the sheet metal shell 12 is desirably larger than the corresponding lateral area covered by the sheet metal face 13. The sheet metal face 13 is disposed generally vertically to extend from the head portion 26 of the shell 12 to generally intermediate the foot portions 23, 24 of the shell 12, and with the outward longitudinal edges 32, 33 of the lateral leg portions of the sheet metal face 13 abutting and being welded to the base surface 20 of the sheet metal shell 12. Likewise, the spaced facing edges 34, 35, 36, 37 of the side walls 21 of the sheet metal shell 12 also abut and are welded to the outward surfaces of the lateral leg portions of the sheet metal face 13.

Substantially square openings 28, 30 are cut respectively in the upper head portion 26 of the sheet metal shell 12 and in the facing upper end of the sheet metal face 13 for horizontal alignment of the openings 28, 30 with one another to form a passageway in which a suction removal conduit (not shown) may be supported. The sheet metal portions cut from the sheet metal shell 12 and the sheet metal face 13 to form the openings 28, 30 are bent inwardly to form edge abutting flaps which are welded to one another as shown in FIG. 1.

A pair of openings 40, 41 are also formed in spaced, generally horizontal alignment with one another in the head portion 26 of the base surface 20 of the sheet metal shell 12 immediately above the opening 28 to function as receptacles for receiving and supporting components of the textile machine. Similarly, three openings 42, 43, 44 are formed as additional receptacle openings in generally spaced horizontal alignment with one another in the base surface 20 of the sheet metal shell 12 intermediate its head portion 26 and its foot portions 23, 24.

A pair of openings 46, 47 are also formed respectively in horizontally aligned side walls 21 bordering the foot portion 23, 24 of the sheet metal shell 12, the openings 46, 47 thereby forming through bores to receive, for example, lifting rods or the like.

Thus, the sheet metal shell 12 forms a base member of the intermediary support stand 10 while the sheet metal face 13 serves as a brace member to rigidify the sheet metal shell 12 and defines therewith a box-like hollow main body of the support stand 10 which is open both at its top and bottom. Of course, as those persons skilled in the art will understand, other profiled sheet metal members may also be utilized for increasing the rigidity of the support stand 10. The openings 40 through 44 serve as receptacles for receiving fasteners or other fastening means by which components of the spinning or other textile machine, particularly longitudinally extending components thereof, may be fastened and supported in desired disposition. For example, a bridge member 15 and a head member 17 (FIG. 2), which may preferably be fabricated by a casting process, may be utilized as fasteners to be affixed to the intermediary support stand 10.

As seen in FIG. 1, the cast bridge member 15 is provided with bores which align with the receptacle openings 42, 43, 44 in the base surface 20 of the sheet metal 12 by which the bridge member 15 is permanently affixed to the sheet metal shell 12 of the support stand 10 utilizing suitable fasteners such as bolts, pins or the like. In this manner, the bridge member 15 is disposed generally horizontally, the bridge member 15 being of a sufficient length to project laterally outwardly beyond the opposite sides of the support stand 10. The bridge member 15 has shank portions 50, 51 formed at its opposite ends by bending opposite end portions of the bridge member 15 generally at right angles with respect to the main body thereof. Bores 53, 54 are formed in the shank portions 50, 51 of the bridge member 15 to enable longitudinally extending components of the textile machine to be fastened to the bridge member 15 and thereby to the intermediary support stand 10.

Figure 2:
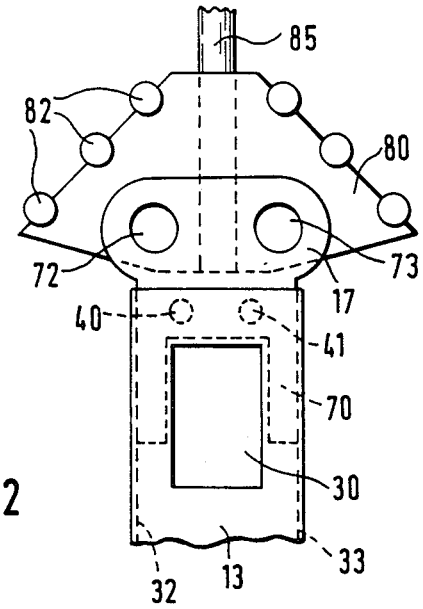
FIG. 2 is an elevational view of the upper head portion of the intermediary support stand of FIG. 1, supporting a head fastener component.

As seen in FIG. 2, the head member 17 has an insert portion 70 adapted to be telescopically inserted into the open upper end of the hollow body of the intermediary support stand 10, the head member 17 being formed with bores which align with the openings 40, 41 in the head portion 26 of the sheet metal shell 12 by which the head member 17 is permanently affixed to the sheet metal shell 12 by suitable fasteners such as bolts, pins or the like. A pair of openings 72, 73 are formed in the exposed portion of the head member 17 projecting upwardly from the main body of the intermediary support stand 10 for receiving in the openings 72, 73 longitudinally extending components of the textile machine. The head member 17 further includes a carrier component 80 adapted to support horizontal rolls 82 and an upward creel frame carrier rod 85.

Figure 3:
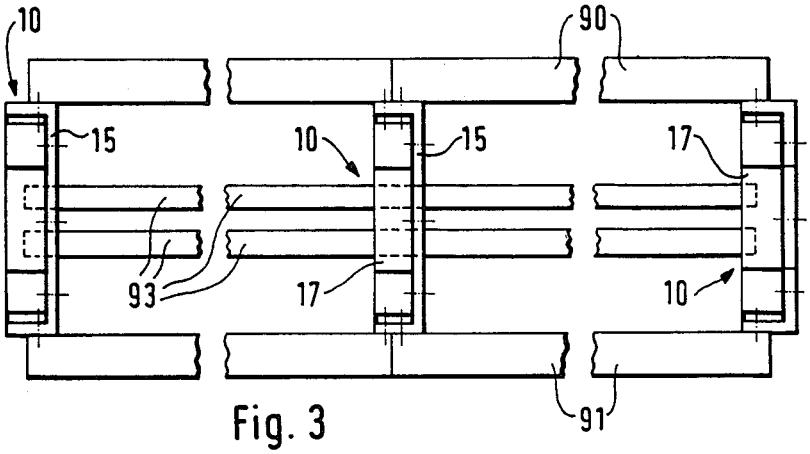
FIG. 3 is a top plan view of three of the intermediary support stands of FIG. 1 arranged in spaced parallel relationship for fastening and supporting lengthwise components of a textile spinning machine.

FIG. 3 schematically depicts three of the intermediary support stand 10 as incorporated in a spinning mill machine. The support stands 10 in such embodiment are disposed in substantially parallel spaced facing relationship with respective longitudinal components of the spinning machine being affixed to the support stands 10. Specifically, drafting device carriers 93 extend longitudinally along the spinning machine through the respective openings 72, 73 in the head members 17 of the support stand 10. Similarly, spindle bearing plates 90, 91 extend longitudinally of the spinning machine along opposite sides thereof with mounting elements of the bearing plates 90, 91 being fastened to the respective shank portions 50, 51 at the opposite ends of the cast bridge members 15 by means of suitable fasteners, such as bolts or the like, extended through the bores 53, 54 in the shank portions 50, 51. As desired, only a single bore 53, 54 in the shank portions 50, 51 of the bridge members 15 at the opposite ends of the spinning machine need be utilized for supporting the bearing plates 90, 91. In this manner, the spindle bearing plates 90, 91 and the drafting device carriers 93 are supported in parallel relation to one another to form the carrier framework for the spinning machine whereby a plurality of spinning stations may be positioned adjacent to one another longitudinally along both sides of the spinning machine.

In the fabrication of the intermediary support stand 10, blanks may be stamped out of flat planar sheet metal stock to form the sheet metal shell 12 and the sheet metal face 13. The receptacle openings 40 through 44 and the openings 46, 47 in the sheet metal shell 12 may be stamped as part of the same stamping process or may be subsequently bored, drilled or otherwise formed in the sheet blank. Thereafter, the side walls 21 of the sheet metal shell 12 are bent perpendicularly with respect to the main base surface 20 and are welded to one another along their abutting edges 38. Similarly, the blank for the sheet metal face 13 is bent into its desired U-shaped configuration following initial stamping out of flat sheet metal stock.

Following the stamping and bending of the sheet metal shell 12 and sheet metal face 13 into their respective profiled configurations, the sheet metal face 13 is placed onto the base surface 20 of the sheet metal shell 12 in the afore-described relationship and the respective edges 32 through 37 of the profiled members 12, 13 are welded together. The bridge and head members 15, 17 are then affixed to the support stand 10 at the openings 40 through 44, whereupon the intermediary support stand 10 is ready for use to attach and support longitudinal components of the spinning machine.

As desired, the base surface 20 of the sheet metal shell 12 may be formed with additional sets of fastener openings corresponding to the openings 40, 41 and the openings 42, 43, 44, with the additional openings being formed at differing heights in relation to such openings, whereby the bridge and head members 15, 17, together with the carrier component 80, may be attached to the support stand 10 at any of several selected elevations.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A support stand for arrangement in spaced facing relation to another like support stand for mounting longitudinally therebetween machine components of a textile spinning, twisting or like machine, said support stand comprising a profiled sheet metal base member and a profiled sheet metal brace member welded together forming a hollow body portion of said support stand, said base member having a substantially flat main support surface and a plurality of flanges bent at approximately right angles with respect to said main support surface with adjacent edges of said flanges being welded to one another, said main support surface of said base member being preformed with a plurality of receptacles in advance of welding of said base and brace members for fastening of said maching components and said brace member rigidifying said base member.

2. A support stand according to claim 1 and characterized further in that said brace member is substantialy U-shaped having lateral leg portions by which said brace member is welded to said main support surface of said base member.

3. A support stand according to claim 2 and characterized further in that said main support surface of said base member is of a larger area than said U-shaped brace member, said brace member being welded to said main support surface of said base member in a substantially vertical disposition.

4. A support stand according to claim 1 and characterized further in that said base member includes a pair of spaced foot portions.

5. A support stand according to claim 1 and characterized further by fasteners affixed to said receptacles, said fasteners having respective receptacles disposed out of co-planar relation with said main support surface of said base member.

6. A support stand according to claim 1 and characterized further by fasteners affixed to said receptacles, said fasteners being cast components.

* * * * *